US007226363B2

(12) United States Patent
Han et al.

(10) Patent No.: US 7,226,363 B2
(45) Date of Patent: Jun. 5, 2007

(54) GRIP FOR GOLF CLUB AND GOLF CLUB EQUIPPED WITH THE SAME

(75) Inventors: Jaeman Han, Seongnam-si (KR); Changseok Lee, Seongnam-si (KR); Jeehoon Kim, Seongnam-si (KR)

(73) Assignee: Income Korea Co., Ltd. (KR)

( * ) Notice: Subject to any disclaimer, the term of this patent is extended or adjusted under 35 U.S.C. 154(b) by 27 days.

(21) Appl. No.: 11/266,897

(22) Filed: Nov. 3, 2005

(65) Prior Publication Data

US 2006/0287124 A1 Dec. 21, 2006

(30) Foreign Application Priority Data

Jun. 17, 2005 (KR) ..... 10-2005-0052459

(51) Int. Cl.
*A63B 53/14* (2006.01)

(52) U.S. Cl. ..... 473/303

(58) Field of Classification Search ..... 473/201, 473/203, 300–303, 549–552, 568; D21/756; D8/DIG. 6–8; 81/489; 16/421, 430, DIG. 12, 16/DIG. 19; 280/821
See application file for complete search history.

(56) References Cited

U.S. PATENT DOCUMENTS 2,482,120 A * 9/1949 Mishkinis ..... 473/203
2,627,410 A * 2/1953 Mishkinis ..... 473/203
2,704,668 A * 3/1955 Park ..... 473/300
5,653,643 A * 8/1997 Falone et al. ..... 473/300
2003/0228929 A1 * 12/2003 Miyasu et al. ..... 473/300

FOREIGN PATENT DOCUMENTS

GB 2120557 * 12/1983
JP 2000-176061 6/2003
JP 2003-180892 7/2003

* cited by examiner

*Primary Examiner*—Stephen Blau
(74) *Attorney, Agent, or Firm*—Lahive & Cockfield, LLP

(57) ABSTRACT

Disclosed are a grip and a golf club equipped with the same. The grip includes a first protrusion formed at one side of an inner peripheral surface of the grip while extending lengthwise along the grip by a predetermined distance and protruding inward from the grip, the first protrusion being biased outward as a shaft has been inserted into the grip so that an outer peripheral surface of the grip protrudes outward; and a second protrusion formed at an upper portion of the first protrusion while extending lengthwise along the grip by a predetermined distance, the second protrusion being protruded more that the first protrusion and having a width larger than that of the first protrusion, the second protrusion being biased outward as the shaft has been inserted into the grip so that the outer peripheral surface of the grip protrudes outward.

16 Claims, 4 Drawing Sheets

GRIP FOR GOLF CLUB AND GOLF CLUB EQUIPPED WITH THE SAME

RELATED APPLICATION

This application is a U.S. Non-Provisional Patent Application which claims priority to Korean Patent Application No. 2005-52459, filed Jun. 17, 2005, the contents of which are hereby incorporated by reference.

BACKGROUND OF THE INVENTION

The present invention relates to a grip for a golf club. More particularly, the present invention relates to a grip for a golf club, in which first and second protrusions are formed at an inner peripheral surface of the grip in such a manner that the second protrusion protrudes more than the first protrusion, so, when a shaft is inserted into the grip, an outer peripheral surface of the grip protrudes outward due to physical contact between the shaft and the second protrusion so that the user can stably grip the golf club.

In general, as shown in FIG. 1, a grip for a golf club has a sectional shape of circle or an oval. In addition, the grip is fabricated in such a manner that the grip has the same diameter at upper and lower portions thereof or the grip is slightly tapered. Such a structure of the grip makes it difficult for the user to stably grip the golf club so that the user may not precisely take a shot. In addition, when taking a swing with the golf club, hands of the user may slide from the grip due to centrifugal force. Also, the golf club may idly rotate in the hands of the user due to improper impact.

To solve the above problem, there has been suggested a technique for preventing hands of the user from slipping from the grip due to centrifugal force by forming a non-slip groove at a portion of the grip corresponding to a left little finger of the user. However, in this case, the centrifugal force is concentrated on the left little finger and the frictional force cannot be distributed over the entire area of the palm of the hand, which hampers close adherence between the hands and the grip.

Applicant of the present invention has filed a patent application entitled "Grip for Golf Club" with the Korean Intellectual Property Office (patent application Ser. No. 10-2004-0077476), in which the grip has an upper portion having a diameter larger than that of a lower portion thereof, and a cross section of the upper portion of the grip has an oval shape.

However, according to the grip for the golf club disclosed in the above Korean patent application, a protrusion is formed at an outer peripheral surface of the grip in the course of fabrication. Thus, the golf club gets torsional stress as of impact. Such torsional stress may significantly increase in the case of a missed impact. In addition, after the grip has been fabricated through the injection molding process, it is necessary to perform sanding work to remove debris formed at the outer peripheral surface of the grip and to make the outer surface of the grip unsmooth. However, since a worker manually performs the sanding work, it is difficult to regulate the degree of protrusion of the outer surface of the grip.

In addition, as shown in FIGS. 2*a* and 2*b*, the conventional grip has a protrusion 201 extending lengthwise along an inner peripheral surface of the grip. A shaft is thrusted into the grip while pushing out the protrusion 201. Thus, when the shaft is placed id the grip, the outer peripheral surface of the grip protrudes outward. The protrusion helps the grip closely adhere to the hands of the user when the user takes a swing with the golf club.

However, according to the conventional grip for the golf club, the protrusion 201 may protrude inward from the grip with a height of about 1 mm, so the outer peripheral surface of the grip may not sufficiently protrude outward from the grip even after the shaft has been inserted into the grip. Thus, the golf club cannot sufficiently adhere to the hands of the user.

SUMMARY OF THE INVENTION

The present invention has been made to solve the above problems occurring in the art. Thus, it is an object of the present invention to provide a grip for a golf club, which enables a golfer to take a precise shot while realizing a long flight distance of a golf ball by allowing the golfer to stably hold the grip for the golf club while distributing centrifugal force over the whole area of the palm of the hand when the user takes a swing with the golf club, thereby preventing the hands of the golfer from being mismatched with the golf club after the swing, improving the skill of a golfer.

Another object of the present invention is to provide a grip for a golf club enabling a golfer to securely hold the grip for the golf club such that torsion may not occur in the golf club at the point of impact while standardizing the protruding degree of the grip when fabricating the grip for the golf.

To achieve these objects, the present invention provides grip for a golf club comprising: a first protrusion formed at one side of an inner peripheral surface of the grip while extending lengthwise along the grip by a predetermined distance and protruding inward from the grip, the first protrusion being biased outward as a shaft has been inserted into the grip so that an outer peripheral surface of the grip protrudes outward; and a second protrusion formed at an upper portion of the first protrusion while extending lengthwise along the grip by a predetermined distance, the second protrusion being protruded more that the first protrusion and having a width larger than that of the first protrusion, the second protrusion being biased outward as the shaft has been inserted into the grip so that the outer peripheral surface of the grip protrudes outward.

BRIEF DESCRIPTION OF THE DRAWINGS

The foregoing and other objects and advantages of the present invention will become apparent from the following detailed description when taken in conjunction with the accompanying drawings, in which.

DETAILED DESCRIPTION OF THE PREFERRED EMBODIMENTS

Hereinafter, the present invention will be described with reference to accompanying drawings. Wherever possible, the same reference numbers will be used throughout the drawings to refer to the same or like parts. In the following description of the present invention, a detailed description of known functions and configurations incorporated herein will be omitted when it may make the subject matter of the present invention rather unclear.

Figure 1:
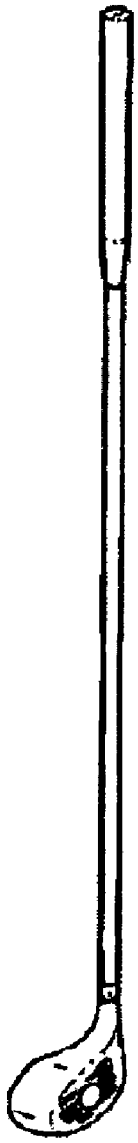
FIG. 1 is a perspective view illustrating a conventional grip for a golf club.
Figure 2A:
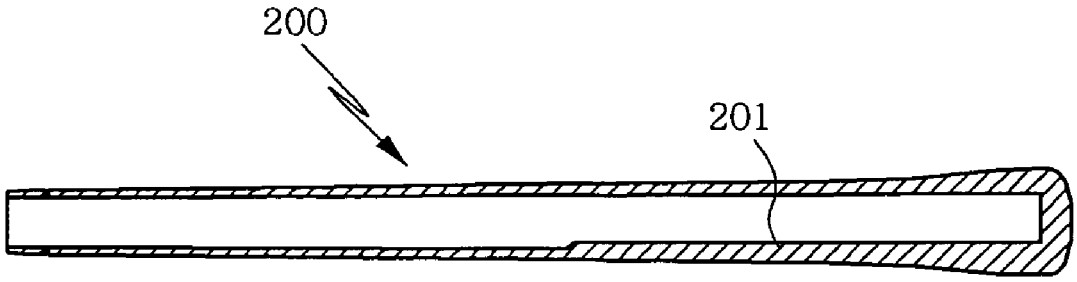
FIGS. 2*a* and 2*b* are longitudinal and cross sectional views illustrating conventional grips for golf clubs, respectively.
Figure 2B:
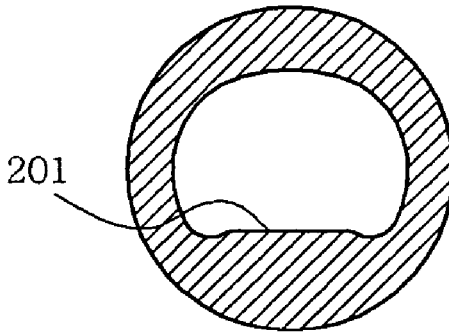
Figure 3:
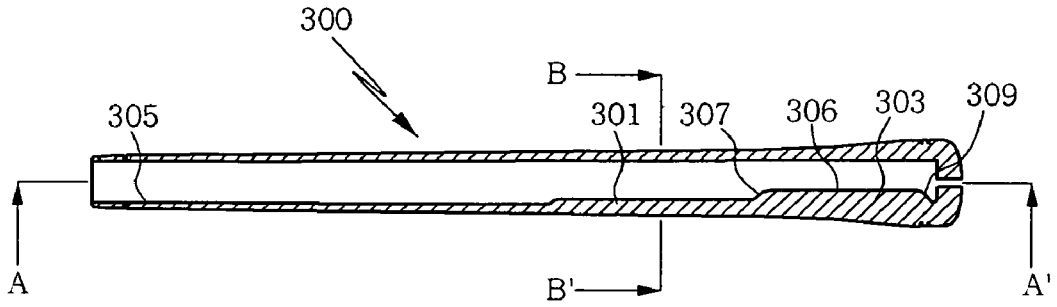
FIG. 3 is a longitudinal sectional view illustrating a grip for a golf club according to one embodiment of the present invention.
Figure 4:
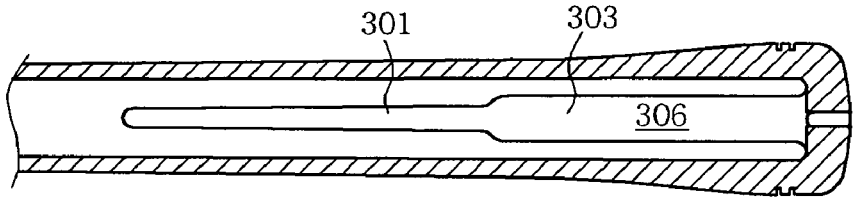
FIG. 4 is a sectional view taken along line A–A' shown in FIG. 3.
Figure 5:
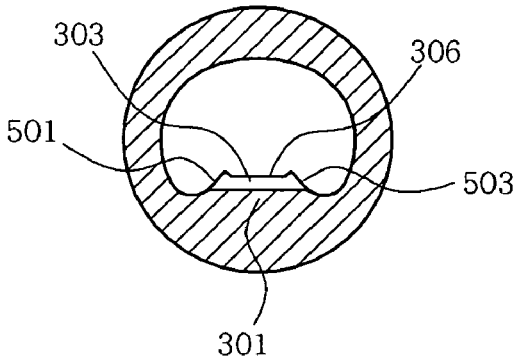
FIG. 5 is a sectional view taken along line B–B' shown in FIG. 3.

FIG. 3 is a longitudinal sectional view illustrating a grip for a golf club according to one embodiment of the present invention, FIG. 4 is a sectional view taken along line A–A' shown in FIG. 3 and FIG. 5 is a sectional view taken along line B–B' shown in FIG. 3.

As shown in FIGS. 3 to 5, the grip for the golf club according to one embodiment of the present invention includes: a first protrusion 301 formed at one side of an inner peripheral surface 305 of the grip while extending lengthwise along the grip by a predetermined length and a second protrusion 303 having a first inclination part 307 extending from a lower portion of the inner peripheral surface 305 to an upper portion of the inner peripheral surface 305; a shaft contact part 306 extending from the first inclination part 307; a second inclination part 309 extending from the shaft contact part 306 and making contact with the upper portion of the inner peripheral surface 305; left and right inclination parts 501 and 503 protruding from the inner peripheral surface 305 of the grip towards a center of the grip; and a second protrusion 303 extending lengthwise along the inner peripheral surface 305 of the grip by a predetermined length and having a width larger than that of the first protrusion 301.

The first protrusion 301 is formed at one side of the inner peripheral surface 305 of the grip and extends lengthwise along the grip by a predetermined length while slightly protruding from the inner peripheral surface 305 of the grip. Actually, since an internal section of the grip has a substantially circular shape, the first protrusion 301 may be obtained by bulging a predetermined portion of the circular internal section of the grip such that the predetermined portion has a flat section. Accordingly, if the shaft is inserted into the grip, the shaft may push out the first protrusion 301 so that the outer peripheral surface of the grip protrudes outward from the grip.

As mentioned above, the second protrusion 303 includes the first inclination part 307, the shaft contact part 306, the second inclination part 309, and left and right inclination parts 501 and 503.

The first inclination part 307 makes contact with an upper portion of the shaft when the shaft is inserted into the grip. The first inclination part 307 is inclined towards the upper portion of the grip so that the second protrusion 303 may not be damaged or broken when the upper portion of the shaft makes contact with the first inclination part 307 and the shaft may be smoothly coupled with the inner peripheral surface 305 of the grip. For this reason, the first inclination part 307 is inclined at an angle of about 35 to 43° with respect to the inner peripheral surface 305 of the grip. Preferably, the first inclination part 307 is inclined at an angle of 38 to 41° with respect to the inner peripheral surface 305 of the grip.

In addition, when the shaft is inserted into the grip, tensile force is applied to a boundary between a lower end of the first inclination part 307 and the inner peripheral surface 305 of the grip in the direction of the upper portion of the grip due to the physical contact between the upper portion of the shaft and the first inclination part 307. In order to prevent the boundary from being broken due to the tensile force, preferably, the boundary area should be formed smoothly curved.

When the shaft is placed in the grip, the shaft contact part 306 of the second protrusion 303 makes contact with an outer peripheral surface of the shaft. At this time, the shaft presses the shaft contact part 306 of the second protrusion 303 such that the second protrusion 303 protrudes outward from the grip. In order to make the shaft be firmly coupled with the inner peripheral surface 305 of the grip, preferably, the shaft closely adheres to the shaft contact part 306 of the second protrusion 303. For this reason, a surface of the shaft contact part 306 is recessed inward in such a manner that the surface of the shaft contact part 306 closely adheres to the outer peripheral surface of the shaft.

The second inclination part 309 extends from the shaft contact part 306 and makes contact with the upper portion of the inner peripheral surface 305 of the grip. When the shaft is placed in the grip, the shaft may press the second protrusion 303 towards the upper portion of the grip, so a boundary between the second protrusion 303 and the inner peripheral surface 305 of the grip may be damaged or broken. In order to prevent the boundary from being broken, the second inclination part 309 is inclined towards the upper portion of the inner peripheral surface 305 of the grip. If the shaft contact part 306 directly contacts with the upper portion of the inner peripheral surface 305 of the grip without forming the second inclination part 309, the upper portion of the inner peripheral surface 305 of the grip may be wrinkled after the shaft has been inserted into the grip. The present invention solves the above problem by forming the second inclination part 309.

More preferably, the boundary between the upper portion of the second inclination part 309 and the inner peripheral surface 305 of the grip is smoothly curved. However, the present invention is not limited thereto. The second inclination part 309 is inclined at an angle of about 35 to 43° with respect to the inner peripheral surface 305 of the grip. Preferably, the second inclination part 309 is inclined at an angle of 38 to 41° with respect to the inner peripheral surface 305 of the grip.

The left inclination part 501 and the right inclination part 503 extend radially inward from the inner peripheral surface 305 of the grip, thereby forming lateral portions of the second protrusion 303, respectively. In order to prevent the second protrusion 303 from being biased in the left direction or the right direction of the grip when the shaft is installed in the grip, the left and right inclination parts 501 and 503 are smoothly inclined in the radial direction of the grip. In addition, in order to prevent a boundary between the inner peripheral surface 305 of the grip and the left and right inclination parts 501 and 503 of the second protrusion 303 from being damaged or broken when the second protrusion 303 is biased in the left direction or the right direction caused by the shaft inserted into the grip, the boundary is preferably curved.

In the meantime, a core is formed at an inner portion of the second protrusion 303. The core is made from a material identical to or different from that of other parts of the grip. The core helps the shaft contact part 306 of the second protrusion 303 more closely adhere to the outer peripheral surface of the shaft after the shaft is installed in the grip. Preferably, the core is made by using a rigid material, such as plastic or metal.

If the second protrusion 303 excessively protrudes inward from the inner peripheral surface of the grip, it is very difficult to insert the shaft into the grip. In contrast, if the second protrusion 303 slightly protrudes from the inner peripheral surface of the grip, the outer peripheral surface of the grip may not sufficiently protrude outward from the grip even after the shaft is installed in the grip. The same problem may occur when the second protrusion 303 has an excessively long length or an excessively short length.

Accordingly, the second protrusion 303 extends lengthwise along the grip by a length of about 50 to 95 mm. More preferably, the second protrusion 303 extends lengthwise along the grip by a length of about 60 to 75 mm. In addition, the second protrusion 303 protrudes radially inward from the inner peripheral surface 305 of the grip with a height of about 3 to 5 mm, preferably, 4.3 to 4.7 mm.

Hereinafter, a process for assembling the shaft into the grip having the above construction according to one embodiment of the present invention will be described in detail with reference to FIGS. 6 and 7.

Figure 6:
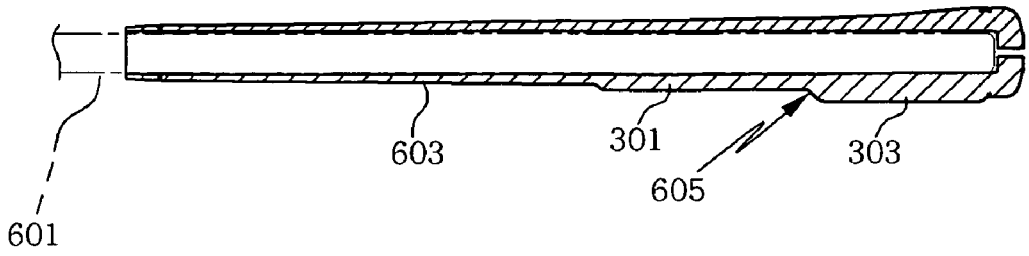
FIG. 6 is a longitudinal sectional view illustrating an assembled state between a shaft and a grip for a golf club when the shaft has been inserted into the grip for the golf club according to one embodiment of the present invention.
Figure 7:
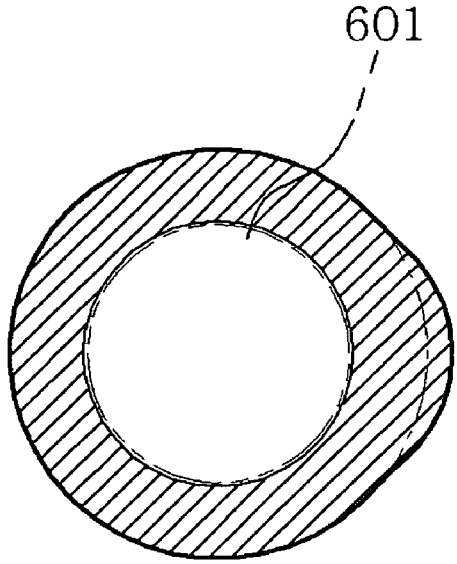
FIG. 7 is a cross sectional view illustrating an assembled state between a shaft and a grip for a golf club when the shaft has been inserted into the grip for the golf club according to one embodiment of the present invention.

As shown in FIGS. 6 and 7, when the shaft 601 is inserted into the grip according to one embodiment of the present invention, the shaft 601 may push out the first and second protrusions 301 and 303 so that the outer peripheral surface 603 of the grip protrudes outward. In addition, a gap, which can be created between the shaft and the inner peripheral surface of the grip, is filled with adhesives.

As the outer peripheral surface 603 of the grip has protruded outward from the grip, the diameter of the upper portion of the grip becomes larger than that of the lower portion of the grip. Thus, the user can stably grip the upper portion of the grip with the left hand while gripping the lower portion of the grip with the right hand, so force may not be excessively concentrated on the right hand of the user at the point of impact.

In addition, since a middle finger contact part 605 is formed on the outer peripheral surface 603 of the grip, it is possible to prevent the left hand from slipping from the grip due to centrifugal force. Since the centrifugal force is mostly exerted upon the left hand of the user and the majority of the centrifugal force exerted upon the left hand of the user may act against the gripping force of the third finger and the middle finger of the left hand, if the middle finger contact part 605 is formed in the grip corresponding to the left hand, the majority of the centrifugal force applied to the left hand of the user is applied to the middle finger contact part 605 and remaining fingers are subject to tensile force. Accordingly, force applied to the left hand of the user may be uniformly distributed by means of the middle finger contact part 605 so that the left hand of the user may not slip from the grip when the user takes a swing with the golf club. Preferably, the middle finger contact part 605 is positioned between the left first finger and the left middle finger when the user holds the grip. However, it is also possible to form the middle finger contact part 605 between the left middle finger and the left third finger or between the left third finger and the left little finger. In addition, since the middle finger contact part 605 is formed on the outer peripheral surface of the grip as the shaft 601 pushes the second protrusion outwards from the grip, the position of the middle finger contact part 605 may depend on the position of the second protrusion.

In addition, even if the outer peripheral surface 603 of the grip protrudes outward from the grip due to the shaft 601 pressing the second protrusion, tension may occur between the outer peripheral surface 603 and other parts of the grip, so that the outer peripheral surface 603 of the grip may be tightened. Thus, torsion of the golf club can be significantly reduced, so that the golf club can be prevented from sliding from the hand of the user at the point of impact.

In the meantime, the grip for the golf club is fabricated by injection molding of an elastic member, such as rubber. Thus, if the protrusion is formed at the outer peripheral surface of the grip when the grip is fabricated through the injection molding process, rubber debris may be formed on the surface of the protrusion. Thus, sanding work need be performed to remove the rubber debris from the protrusion. As mentioned above, since workers manually perform the sanding work, the state of the protrusion may vary depending on the skill of the workers. That is, there may exist a no-uniformity near the protrusion.

However, according to the present invention, the grip is fabricated through the injection molding process while simultaneously forming the first and second protrusions on the inner peripheral surface of the grip. Thus, the outer peripheral surface of the grip can be uniformly formed and the sanding work can be performed with respect to the grip while ensuring uniformity and standardization of the grip.

Although the present invention has been described in relation to the right-handed golf club, the present invention is also applicable for a left-handed golf club.

As described above, according to the present invention, the user can stably hold the grip of the golf club so that the user can take a precise shot while increasing the flight distance of the golf ball. In addition, when the user takes a swing with the golf club, centrifugal force is distributed over the whole area of the palm of the user's hand, thereby preventing the hands of the user from being mismatched with the golf club after the swing, improving the skill of the user.

In addition, according to the present invention, the middle finger contact part is formed on the outer peripheral surface of the grip, so that the left hand (or, the right hand) of the user can be prevented from slipping from the grip due to the middle finger contact part even if centrifugal force is applied to the left hand (or, the right hand) of the user when the user takes a swing.

According to the present invention, even if the outer peripheral surface of the grip protrudes outward from the grip due to the shaft pressing the second protrusion, tension may occur between the outer peripheral surface and other parts of the grip, so that the outer peripheral surface of the grip may be tightened. Thus, torsion of the golf club can be significantly reduced, so that the golf club can be prevented from sliding from the hand of the user at the point of impact.

In addition, according to the present invention, it is not necessary to form the protrusions on the outer peripheral surface of the grip, so that sanding work can be performed with respect to the grip while ensuring uniformity and standardization of the grip.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed:

1. A grip for a golf club comprising:

a first protrusion formed at one side of an inner peripheral surface of the grip while extending lengthwise along the grip by a predetermined length and protruding inward from the grip, the first protrusion being biased outward as a shaft is thrusted into the grip so that an outer peripheral surface of the grip protrudes outward; and a second protrusion formed at an upper portion of the first protrusion while extending lengthwise along the grip by a predetermined length, the second protrusion being protruded more than the first protrusion and having a width larger than that of the first protrusion, the second protrusion being biased outward as the shaft is thrusted into the grip so that the outer peripheral surface of the grip protrudes outward.

2. The grip for the golf club as claimed in claim 1, wherein the second protrusion has a first inclination part extending from a lower portion of the inner peripheral surface toward an upper portion of the inner peripheral surface, a shaft contact part extending from the first inclination part, and a second inclination part extending from the shaft contact part and making contact with the upper portion of the inner peripheral surface.

3. The grip for the golf club as claimed in claim 2, wherein a boundary between the second inclination part and the inner peripheral surface of the grip is smoothly curved.

4. The grip for the golf club as claimed in claim 2, wherein the shaft contact part is recessed inward from the second protrusion.

5. The grip for the golf club as claimed claim 2, wherein the first inclination part is inclined upward at an angle of about 35 to 43° with respect to the inner peripheral surface of the grip.

6. The grip for the golf club as claimed in claim 2, wherein the second inclination part is inclined downward at an angle of about 35 to 43° with respect to the inner peripheral surface of the grip.

7. The grip for the golf club as claimed in claim 1, wherein the second protrusion has left and right inclination parts protruding from the inner peripheral surface of the grip towards a center of the grip.

8. The grip for the golf club as claimed in claim 7, wherein a boundary between the inner peripheral surface of the grip and the left and right inclination parts is smoothly curved.

9. The grip for the golf club as claimed in claim 1, wherein a core is formed at an inner portion of the second protrusion, the core being made from a material identical to or different from a material of the grip.

10. The grip for the golf club as claimed in claim 9, wherein the second protrusion formed in the inner peripheral surface of the grip extends lengthwise along the grip with a length of about 50 to 95 mm.

11. The grip for the golf club as claimed in claim 9, wherein the second protrusion protrudes from the inner peripheral surface of the grip with a thickness of about 3 to 5 mm.

12. A golf club comprising a grip as claimed in claim 1.

13. A golf club comprising:

a grip, wherein the grip includes a first protrusion formed at one side of an inner peripheral surface of the grip while extending lengthwise along the grip by a predetermined length and protruding inward from the grip, the first protrusion being biased outward as a shaft is thrusted into the grip so that an outer peripheral surface of the grip protrudes outward, and a second protrusion formed at an upper portion of the first protrusion while extending lengthwise along the grip by a predetermined length, the second protrusion being protruded more than the first protrusion and having a width larger than that of the first protrusion, the second protrusion being biased outward as the shaft is thrusted into the grip so that the outer peripheral surface of the grip protrudes outward.

14. The golf club as claimed in claim 13, wherein the second protrusion has a first inclination part extending from a lower portion of the inner peripheral surface to an upper portion of the inner peripheral surface, a shaft contact part extending from the first inclination part, and a second inclination part extending from the shaft contact part and making contact with the upper portion of the inner peripheral surface.

15. The golf club as claimed in claim 13, wherein the second protrusion has left and right inclination parts protruding from the inner peripheral surface of the grip towards a center of the grip.

16. The golf club as claimed in claim 13, wherein a core is formed at an inner portion of the second protrusion, the core being made from a material identical to or different from a material for the grip.

* * * * *